US006601725B2

(12) United States Patent
Lafond et al.

(10) Patent No.: US 6,601,725 B2
(45) **Date of Patent: *Aug. 5, 2003**

(54) INTEGRAL ASSEMBLY OF REAGENT TUBES AND SEAL CAPS

(75) Inventors: André Lafond, St-Hilaire (CA); Yanick Bertin, Vercheres (CA)

(73) Assignee: 3088081 Canada, Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/858,161

(22) Filed: May 15, 2001

(65) Prior Publication Data

US 2002/0170911 A1 Nov. 21, 2002

(51) Int. Cl.[7] ..... A47G 19/00
(52) U.S. Cl. ..... 220/23.4; 224/102
(58) Field of Search ..... 220/23.6, 23.2, 220/238, 839, 375; D24/224, 216; 224/102, 104

(56) References Cited

U.S. PATENT DOCUMENTS 5,720,406 A * 2/1998 Fassbind et al. ..... 220/23.4
5,722,553 A 3/1998 Hovatter
5,753,186 A * 5/1998 Hanley et al. ..... 422/100
5,863,791 A * 1/1999 Baldszun et al. ..... 435/5
6,001,310 A * 12/1999 Shaffer et al. ..... 422/102
D439,673 S * 3/2001 Brophy et al. ..... D24/226
D453,573 S * 2/2002 Lafond et al. ..... D24/224

* cited by examiner

*Primary Examiner*—Lee Young
*Assistant Examiner*—Lien Ngo
(74) *Attorney, Agent, or Firm*—Akerman Senterfitt

(57) ABSTRACT

An integral assembly of a multiplicity of spaced reagent tubes arranged in an aligned series wherein the tubes are integrally linked to one another by connecting portions and to a corresponding multiplicity of independently spaced seal caps by a multiplicity of bands, each band having one end integral with a seal cap and an opposite end integrally connected to two adjacent tubes. The bands extend perpendicularly to the series of aligned tubes and include an oblique hinge portion which is deformable so as to allow the cap to be independently manipulatable to pivot angularly and to superimpose the open end of a tube for sealing.

6 Claims, 3 Drawing Sheets

INTEGRAL ASSEMBLY OF REAGENT TUBES AND SEAL CAPS

FIELD OF THE INVENTION

The present invention relates to an integral assembly of a multiplicity of spaced reagent tubes arranged in an elongated aligned series and a corresponding multiplicity of independently spaced sealed caps also arranged in an elongated aligned series and integrally connected to the multiplicity of tubes in a manner so as to allow independent sealing of individual tubes.

BACKGROUND OF THE INVENTION

An integral assembly of micro-centrifuge strip tubes having independently tethered angularly related seal caps is described in U.S. Pat. No. 5,722,553 issued Mar. 3, 1998 to Hovatter wherein the open ends of the tubes are integrally connected by a series of aligned tethers. The independent seal caps are pivotally connected integrally and angularly by a hinge strap to an associated one of the reagent tubes at an angle other than 90° to the elongated aligned series in which the tubes are arranged. The caps are selectively manipulatable in relation to the open end of the associated reagent tube to be superimposed thereover to selectively effect a sealing penetration of a tubular skirt portion of the seal cap into or out of the open end to seal or unseal the open end of the associated tube.

It is noted that, in the assembly described in the above U.S. patent, the axis of the seal caps and that of the associated tubes to which they are tethered are parallel when in a tube open condition; however, they are coincident in a plane that is angularly disposed to the plane coincident with the axis of the aligned tubes at an angle other than 90° to the common plane within which the axis of the tubes are coincident.

When these assemblies are placed in an apparatus, known as a thermal cycler, the seal caps are in the open condition so that they may receive samples that are to be centrifuged. In the arrangement described in the above U.S. patent, the seal caps of one assembly block the entrance of the open end of the tubes of an adjacently or rearwardly disposed assembly thus rendering the sample filling operation cumbersome and slow as each row of caps must be closed before proceeding with a next row instead of carrying out this operation only at the end when all the assemblies are sample filled.

Furthermore, the tether straps of the above Hovatter patent which inter-connect the tubes are narrow and thin, thus rendering the connection between the tubes rather flexible so that the manipulation of an assembly is difficult as the latter must be manually held in a substantially right plane.

OBJECTS AND STATEMENT OF THE INVENTION

It is an object of the present invention to provide an assembly of the type described wherein the seal caps and their hinge bands are in a plane which is 90° to the plane of the aligned series of tubes and which extends between adjacent tubes. The closing of the caps on the tubes is achieved by configuring the hinge bands in a manner such as to provide an angular pivotal movement of the seal caps when moving into a cover relation with their associated tubes.

The present invention therefore relates to an integral assembly which comprises (a) a multiplicity of spaced reagent tubes arranged in an elongated aligned series, the tubes each having an open end and a closed end, the open ends of adjacent tubes integrally connected to one another by a series of connecting portions, (b) a corresponding multiplicity of independently spaced seal caps, each seal cap having a tubular seal skirt portion to sealingly engage the open end of an associated reagent tube, and (c) a corresponding multiplicity of bands having one end integral with a seal cap and an opposite end integrally connected to two adjacent tubes and their associated connecting portion. The bands extend perpendicularly to the series of aligned tubes and each include a hinge portion deformable so as to allow the cap to be independently manipulatable to pivot angularly and to superimpose the open end to thereby selectively effect a sealing penetration of the tubular skirt portion into the open end to seal the open end of an associated reagent tube.

In one form of the invention, each hinge portion has a folding area which has a thickness smaller than the thickness of the overall hinge portion thereby providing flexibility to facilitate the angular movement of the seal cap relative to the tube.

In a further form of the present invention, this folding area has a central opening thus leaving a pair of opposite strip sections that act as pivotal areas of the seal cap to the tube.

In another form of the invention, the connecting portions between the tubes are rigid so as to maintain the assembly in a substantially horizontal straight condition.

In another form of the invention, each connecting portion between the tubes displays a slot that facilitate the separation of a tube from the aligned series of tubes.

In an other embodiment of the invention, the seal caps are each provided with a contamination shield. It has been observed in presently used assemblies that the collar at the open end of each tube is so small that it is practically impossible to remove the seal caps from these ends without manually touching such collar. Indeed, if these collars are accidentally touched, the sample is contaminated. To obviate this, manipulation must be carried with great care and very slowly. The contamination shield overcomes this problem.

The handling and use of reagent tubes when arranged in an integral assembly such as described in the present invention, are greatly facilitated thus saving time, increasing efficiency and augmenting production.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
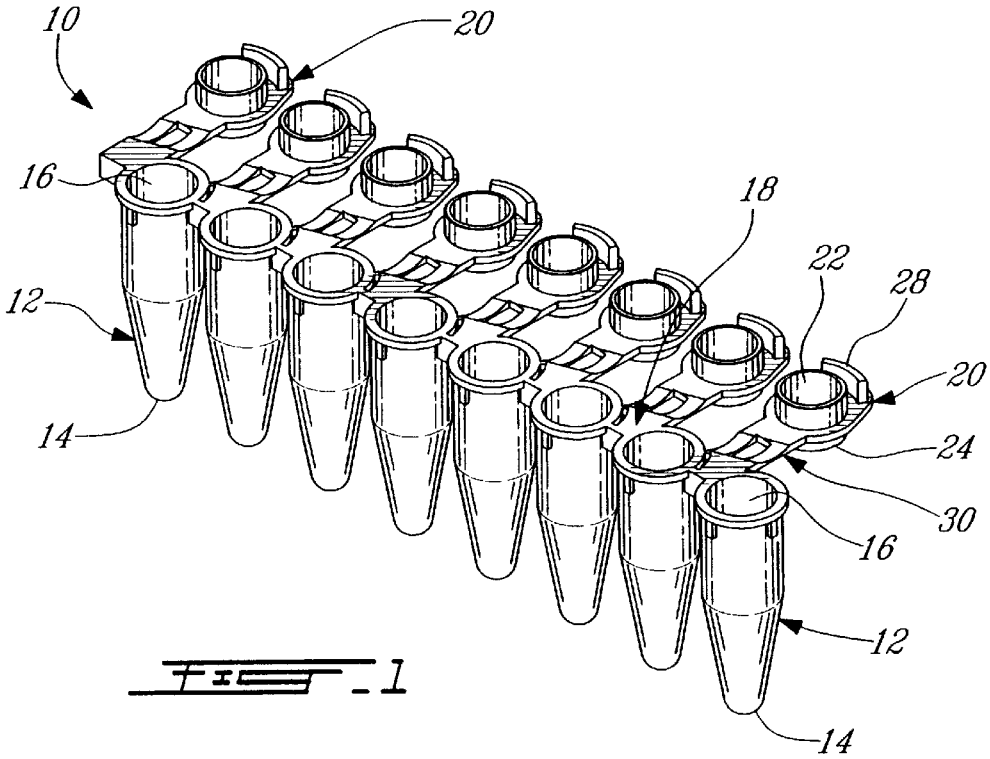
FIG. 1 is a perspective view of an integral assembly of tubes and caps made in accordance with the present invention.

Referring to FIGS. 1–6, there is shown an integral assembly, generally denoted 10, made in accordance with the present invention.

This assembly comprises, in the embodiment illustrated, eight reagent tubes 12, each having a closed end 14 and an open end 16. The series of eight tubes are aligned along a common axis. The upper open ends of the tubes are integrally and serially connected to one another by a series of connecting portions 18 (it should be understood that, referring to FIG. 2, the last band on tube 12 shown at left of the series is of course connected only to one tube).

The integral assembly 10 also comprises a corresponding number of independently spaced seal caps 20. There are as many seal caps 20 as there are tubes and the caps are also aligned along a common axis, which axis is parallel to the tube axis described above.

Each cap 20 includes a tubular skirt portion 22 and a top portion 24 in the shape of a dome. The tubular portion 22 is integral with a flat surface area 26 from which depends an arc-shaped segment 28, the function of which will be described further hereinbelow.

Figure 2:
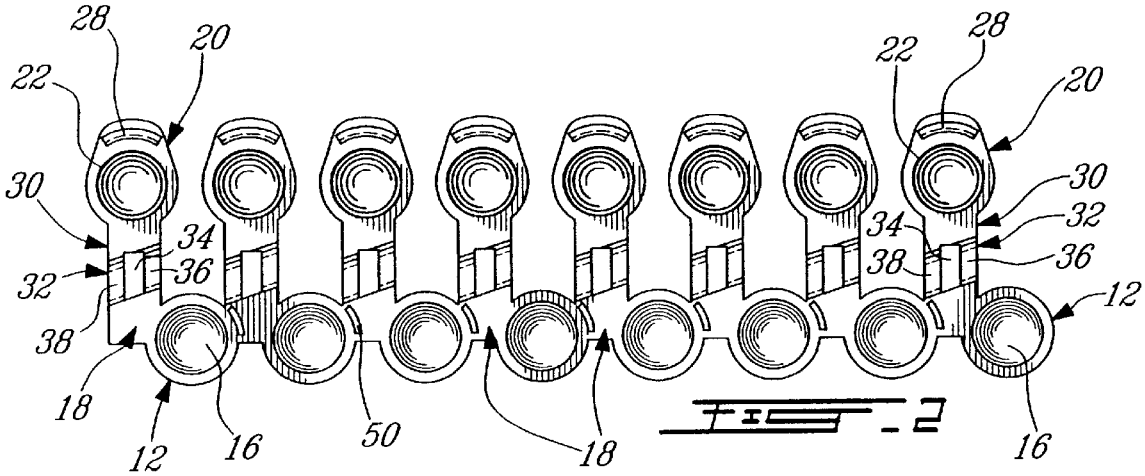
FIG. 2 is a top plan view thereof.

The integral assembly 10 also comprises a corresponding multiplicity of bands 30 connecting the caps 20 to the portions 18; the bands are integral, at one end, with the seal caps 20 and, at their opposite end, to parts of the peripheral edges of two adjacent tubes as well as to their corresponding connecting portion 18. As can be seen in FIG. 2, the connecting bands 30 extend perpendicularly to the axis of the reagent tubes 12 as well as to the axis of the seal caps 20.

The bands 30 each define a flexible folding area 32 which is of a thickness smaller than that of the remaining overall portion of the band. This folding area displays a central opening 34 thus defining a pair of strips 36 and 38.

Figure 3:
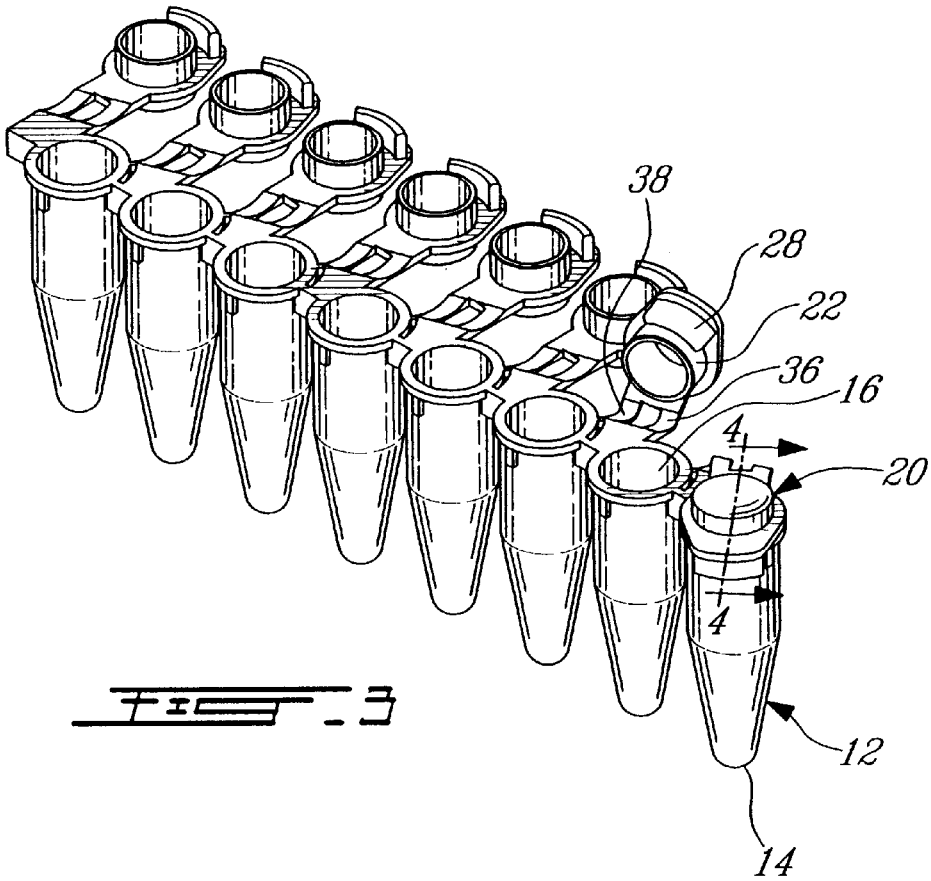
FIG. 3 is a perspective view showing one tube of the aligned series of tubes being sealingly covered with a cap.
Figure 5:
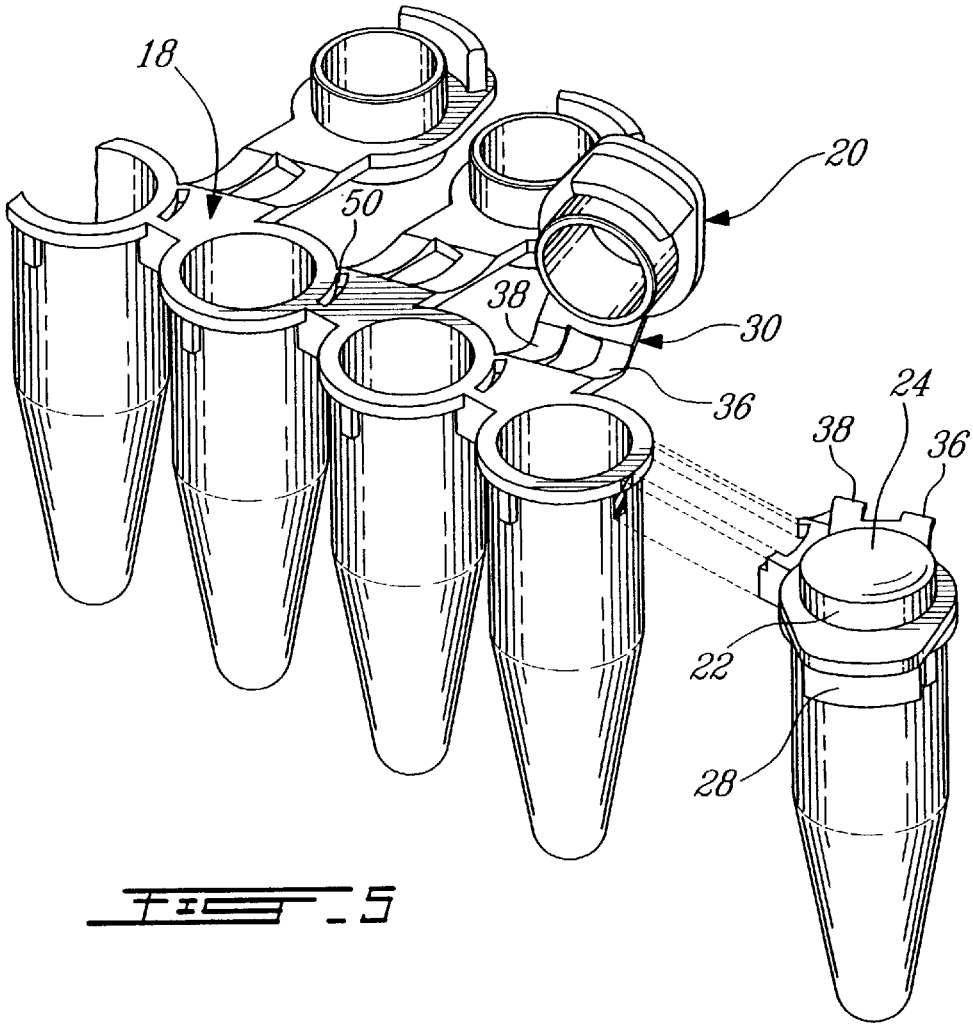
FIG. 5 is a perspective view showing one sealed tube being disconnected from the aligned series of tubes.
Figure 6:
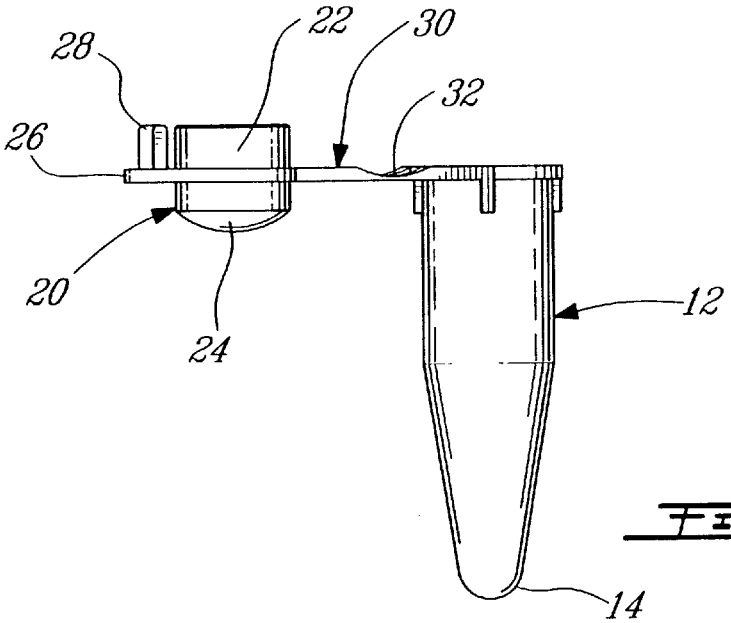
FIG. 6 is an elevation view of one tube with its connecting band and its cap.

Referring more particularly to FIGS. 3 and 5, the folding operation of a seal cap is illustrated whereby the seal cap, although extending perpendicularly to the aligned series of tubes, is angularly pivoted so that its skirt portion 22 may be moved and superimpose to close the open end 14 of the tube.

Figure 4:
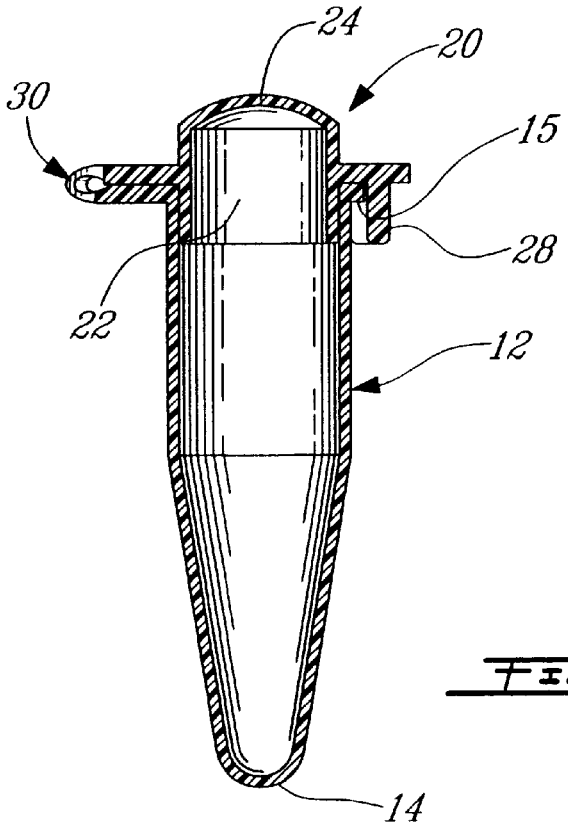
FIG. 4 is a cross sectional view taken along lines 4—4 of FIG. 3.

Referring to FIG. 4, the arc-shaped segment 28 extends at a slight distance from the outer wall of the tube so as to allow a finger gripping arrangement whereby manipulation of the seal may be carried out without contact with the peripheral edge 15 of the tube.

In one preferred form of the invention, the connecting portion 18 between each tube is provided with a slot 50 which facilitates manual detachment of one tube from its adjacent tube or from the series of tubes.

The entire assembly of the present invention is made of injection molded plastic material.

Although the invention has been described above in relation to one form, it will be evident to the person skilled in the art that it may be modified and refined in various ways. For example, the dome-shaped cover of the cap may have a relatively smaller thickness so as to allow easy insertion of a needle to have access to the contents inside the tube. Other ways of modifying the dome-shaped cover are also possible to enable such needle insertion. It is therefore wished to have it understood that the present invention should not be limited in scope, except by the terms of the following claims.

What is claimed is:

1. An integral assembly of (a) a multiplicity of spaced reagent tubes arranged in an elongated aligned series, said tubes each having an open end and a closed end, the open ends of adjacent tubes integrally connected to one another by a series of connecting portions, (b) a corresponding multiplicity of independently spaced seal caps, each seal cap having a tubular seal skirt portion to sealingly engage the open end of an associated reagent tube, and (c) a corresponding multiplicity of bands having one end integral with a seal cap and an opposite end integrally connected to two adjacent tubes and their associated connecting portion; said band extending perpendicularly to said series of aligned tubes and including a hinge portion deformable so as to allow said cap to be independently manipulatable to pivot angularly and to superimpose said open end to thereby selectively effect a sealing penetration of said tubular skirt portion into said open end to seal the open end of an associated reagent tube.

2. An integral assembly as defined in claim 1, wherein said hinge portion has a folding area having a thickness smaller than the thickness of the overall hinge portion to facilitate angular pivotal movement of the seal cap relative to said tube.

3. An integral assembly as defined in claim 2, wherein said folding area displays a central opening thereby defining a pair of opposite strip sections to further facilitate pivotal movement of the seal cap relative to said tube.

4. An integral assembly as defined in claim 1, wherein each said seal cap displays an arc-shaped projection thereby providing a contamination shield when said cap is in sealing penetration with said tube.

5. An integral assembly as defined in claim 1, wherein said connecting portions displays a slot to facilitate separation of a tube from said aligned series of tubes.

6. An integral assembly as defined in claim 1, wherein said seal cap has a pierceable top wall to enable needle access into a sealed tube.

* * * * *